US005873532A

United States Patent [19]

Fontanille

[11] Patent Number: 5,873,532

[45] Date of Patent: Feb. 23, 1999

[54] BALL MILL

[75] Inventor: Daniel Fontanille, Hermeray, France

[73] Assignee: GEC ALSTHOM Stein Industrie, Velizy-Villacoublay, France

[21] Appl. No.: 813,089

[22] Filed: Mar. 7, 1997

[30] Foreign Application Priority Data

Mar. 8, 1996 [FR] France ..... 96 02953

[51] Int. Cl.[6] ..... B02C 17/00

[52] U.S. Cl. ..... 241/52; 241/57; 241/79.1; 241/171; 241/174

[58] Field of Search ..... 241/171, 174, 241/52, 47, 57, 79.1

[56] References Cited

U.S. PATENT DOCUMENTS

| | | | |
|---|---|---|---|
| 744,451 | 11/1903 | Abbe | 241/171 |
| 792,778 | 6/1905 | Koneman | 241/171 X |
| 926,441 | 6/1909 | Shafter | 241/171 X |
| 927,054 | 7/1909 | Knecht | 241/171 X |
| 931,045 | 8/1909 | Emerick | 241/171 |
| 1,719,971 | 7/1929 | Fahland | 241/171 |
| 2,174,630 | 10/1939 | Hardinge | 241/171 X |
| 4,265,322 | 5/1981 | Emonet | 173/169 |
| 4,750,677 | 6/1988 | Taylor | 241/5 |

FOREIGN PATENT DOCUMENTS

| | | |
|---|---|---|
| 1323748 | 5/1903 | France . |
| 2591127A1 | 6/1987 | France . |
| 2721711 | 12/1995 | France . |
| 3130925A1 | 2/1983 | Germany . |
| 819957 | 9/1959 | United Kingdom . |

*Primary Examiner*—Joseph J. Hail, III
*Assistant Examiner*—William Hong
*Attorney, Agent, or Firm*—Sughrue, Mion, Zinn, Macpeak & Seas, PLLC

[57] ABSTRACT

The present invention relates to a ball mill having a substantially horizontal axis of rotation and including a drum supported by two trunions having the same axis of rotation and situated at respective ends of the drum, raw coal being conveyed by substantially vertical pipework to the vicinity of a cylinder having the same axis of rotation and disposed within each trunion so as to open out into the drum, with the space lying between each trunion and its cylinder being connected to a pulverized coal outlet duct via a separator. A raw coal guide member is disposed beneath the pipework, conveying coal under gravity into the inside of the cylinder which includes a rigid Archimedes' screw on its inside surface, a main air feed being provided on said pipework upstream from the separator, all of said air being channeled towards the inside of the cylinder.

6 Claims, 2 Drawing Sheets

BALL MILL

FIELD OF THE INVENTION

The present invention relates to a ball mill.

More precisely, the invention relates to a ball mill having a substantially horizontal axis of rotation and comprising a drum supported by two trunions having the same axis of rotation and situated at respective ends of said drum, raw coal being conveyed by substantially vertical pipework to the vicinity of a cylinder having the same axis of rotation and disposed within each trunion so as to open out into the drum, with the space lying between each trunion and its cylinder being connected to a pulverized coal outlet duct via a separator.

BACKGROUND OF THE INVENTION

Within each trunion of such a mill that is known, there is disposed a hollow cylinder carrying a resilient Archimedes' screw on its outside surface for the purpose of feeding raw coal, and onto which the raw coal falls from the pipework so as to be conveyed into the drum. "Main" air is injected into the drum via the inside of the cylinder so as to entrain the grains as milled inside the drum. The space between the trunion and the screw serves to evacuate the pulverized coal and it is connected to a separator. Additional air is injected into the pipework upstream from the separator.

By way of example, one such mill is described in patent application FR 2 721 711.

That type of mill suffers from the following technical problems.

It turns out that small quantities of additional air are incapable of providing effective pre-drying of the coal, with air flow rate being low when the mill is operating at full load.

Raw coal dropping onto the blades of the resilient screw gives rise rapidly to major wear thereof. This wear is accelerated by the pulverized coal as mixed with air passing through said space between the trunion and the screw.

Thus, said space serves both to feed raw coal into the drum and also to extract pulverized coal for feeding to the separator. These two flows of matter in opposite directions generate turbulence and a flow that is disturbed, thereby giving rise to high headlosses and to poor distribution of air and of pulverized coal within the separator.

OBJECTS AND SUMMARY OF THE INVENTION

According to the invention, to solve these problems, a raw coal guide member is disposed beneath said pipework, conveying coal under gravity into the inside of said cylinder which includes a rigid Archimedes' screw on its inside surface, a main air feed being provided on said pipework upstream from the separator, all of said air being channeled towards the inside of the cylinder.

Main air feed via the cylinder enables said air to be fed centrally into the drum along the axis of rotation, and ensures an optimal effect therefor.

It is also easy for this main air to be controlled, with its flow rate serving to determine the quantity of pulverized coal that leaves the mill.

The rigid Archimedes' screw carried by the cylinder is less fragile in structure than the prior art resilient screw and it is not subjected to wear from falling coal.

The main air flow provides effective pre-drying of the raw coal, whatever the load of the mill.

Raw coal feed and pulverized coal extraction take place via two different paths. This ensures that pulverized coal flows well along the trunion.

For additional air feed purposes, the separator may include an additional air feed and/or said outlet duct may include an additional air feed.

It is thus possible to distribute the additional air between the separator and the pulverized coal outlet duct in such a manner as to achieve effective regulation at all times.

The additional air feed is preferably controlled.

This makes it possible to perform dynamic adjustment of the coal feed rate and to obtain good power control of the boiler which is fed from the pulverized coal outlet duct.

Advantageously, the guide member is an angled sheath connected at its bottom end to one end of the cylinder, the bottom end of the raw coal feed pipework being disposed above said sheath.

Preferably, the separator comprises two coaxial tubular portions about a vertical axis:

- an outer, first tubular portion connected to the trunion via an angled sheath; and
- an inner second tubular portion within which the bottom end of the pipework is disposed and which is connected via its bottom end to the top end of the guide member;
- the first portion being extended and connected to said outlet duct and at least one through orifice being provided from the space between the two tubular portions towards the inside of the second portion.

BRIEF DESCRIPTION OF THE DRAWINGS

The invention is described in greater detail below with reference to the figures which show only a preferred embodiment of the invention.

MORE DETAILED DESCRIPTION

Figure 1:
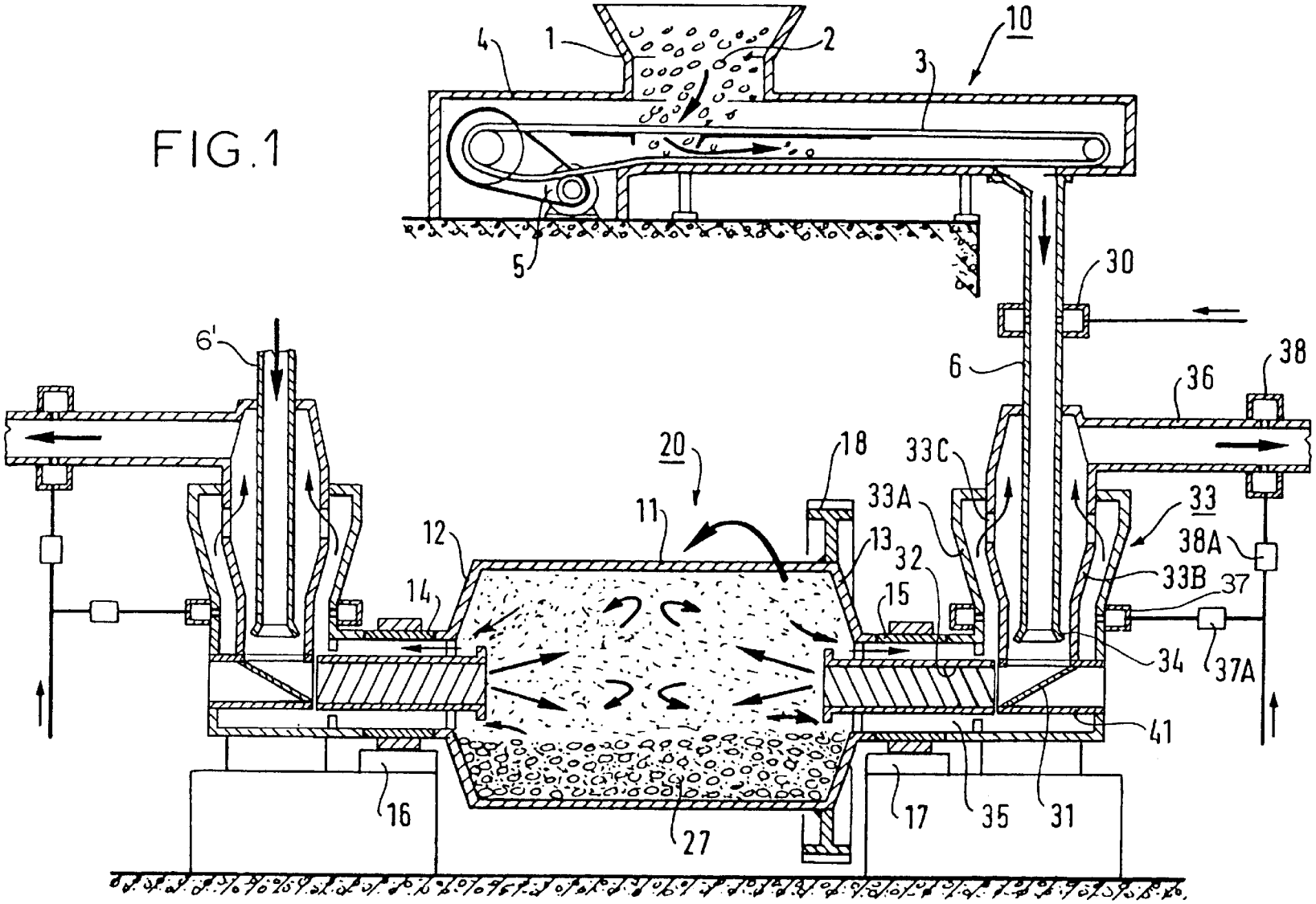
FIG. 1 is a longitudinal section view through a coal milling installation.

As can be seen in FIG. 1, the coal milling installation comprises at least one feed device 10 for feeding a ball mill given overall reference 20 with coal.

The feed device 10 comprises a storage hopper 1 from which coal 2 is taken and fed by a chain conveyor 3 located in a box 4 and driven by a motor 5 to a first end of substantially vertical pipework 6.

The mill 20 comprises a drum having a substantially horizontal axis of rotation and including a cylindrical central portion 11 terminated by two conical portions 12 and 13 having respective trunions 14 and 15 disposed about the same axis of rotation and fixed to the conical portions for the purpose of supporting the drum. The trunions are received in two respective bearings 16 and 17. The mill is rotated via a toothed ring 18 which cooperates with a gear wheel (not shown) driven by an electrical motor and gear box unit (not shown). The mill is provided with balls 27, e.g. steel balls.

The installation is symmetrical and the facilities installed at each end of the drum are likewise symmetrical, each comprising substantially vertical pipework 6, 6' for feeding in raw coal. The description below therefore relates to the facility at one end only.

Raw coal is fed in via the pipework 6. This pipework 6 is provided with a main air feed 30. At the bottom end of the pipework 6, the raw coal falls on a guide member 31 which may be formed by a sloping plate fixed inside a stationary tube 41 whose mouth opens out into a cylinder 32 having the same axis as the drum and disposed facing the bottom end of the pipework 6, a radial orifice being formed in said tube 41, enabling the raw coal from said pipework 6 to fall through onto the plate 31. The plate 31 directs the raw coal under gravity into the cylinder 32 which is disposed inside the trunion 15, and the inside surface of the cylinder has a rigid metal Archimedes' screw leading to the inside of the drum. The cylinder 32 is secured to the drum by means of arms, for example, and it rotates together therewith having the same axis of rotation as the drum. The pipework 6 passes through a separator 33, and as a result the raw coal together with all of the main air is channeled into the cylinder 32 by means of an appropriately shaped sloping plate 31, with a conical member 34 at the bottom of the pipework 6 preventing air rising at this point. The conical member serves another function which is described below.

Once the raw coal has been milled inside the drum, the resulting pulverized coal is extracted via the space 35 that exists between the trunion 15 and the cylinder 32 and that is connected via the separator 33 to an outlet duct 36.

For this purpose, the separator 33 has two coaxial conical tubular portions about a vertical axis:

an outer first portion 33A connected to the trunion 15; and an inner second portion 33B inside which the pipework 6 is disposed, and which is itself connected to the outlet duct 36.

The pulverized coal thus rises in the space between these two portions 33A and 33B and passes into the space between the second portion 33B and the pipework 6 via orifices 33C prior to being extracted via the outlet duct 36.

On passing through the orifices 33C, the pulverized coal follows a zigzag path and the larger particles therein fall towards the bottom of the second portion 33B, whose bottom end opens out into the radial orifice formed through the wall of the tube 41, thus causing the larger particles to be recycled together with the raw coal, with the conical member 34 serving to allow them to pass towards the sloping plate 31.

Two additional air feeds may be provided:

a first feed 37 in the separator 33, at the inlet thereof and controlled by a device 37A; and a second feed 38 that is located downstream on the outlet duct 36 and that is controlled by a device 38A.

Both of these feeds may be provided, or only one of them need be provided.

Figure 2:
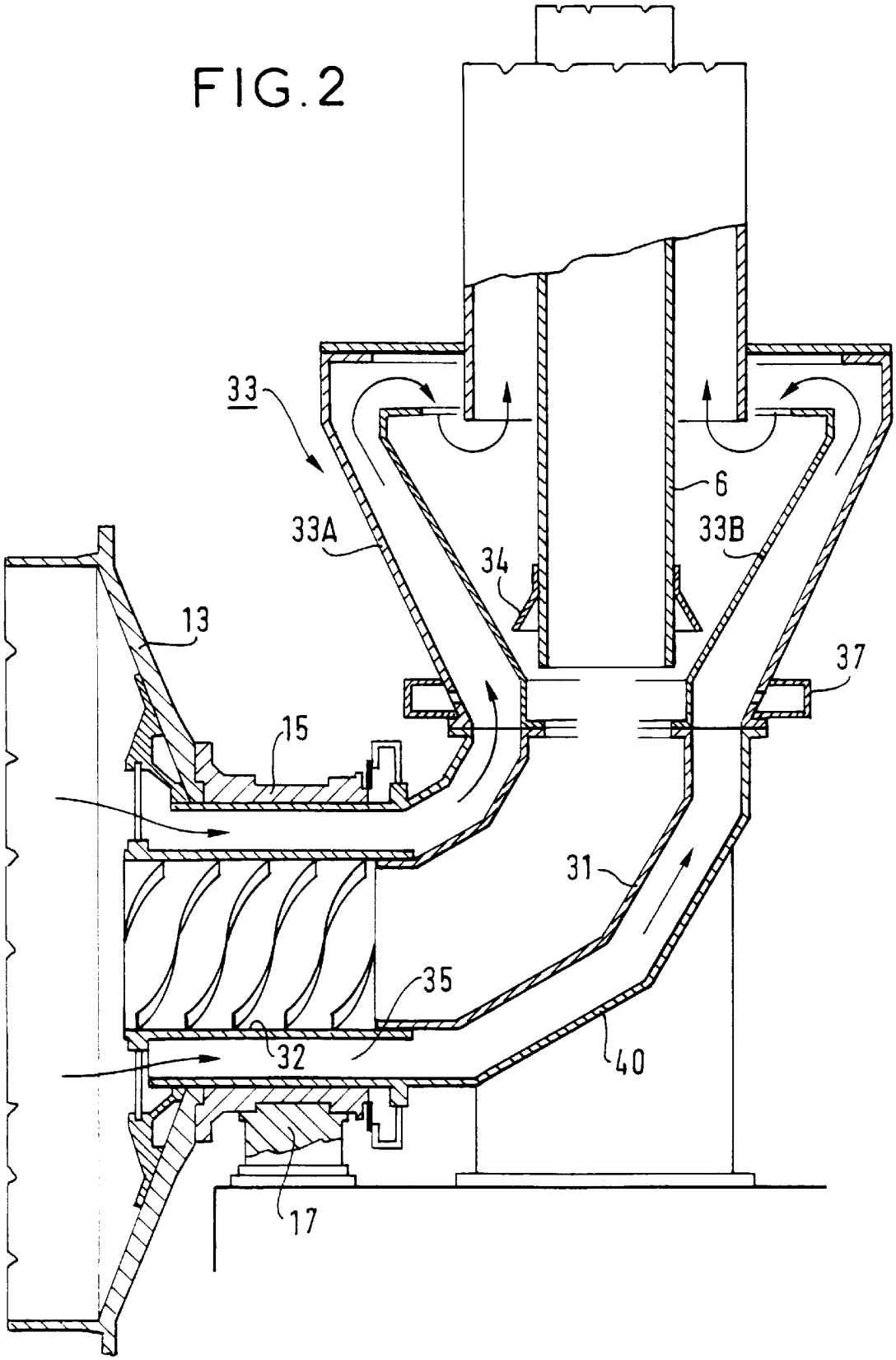
FIG. 2 is a longitudinal section view through a detail of a preferred embodiment of the invention.

FIG. 2 shows another embodiment of the invention.

In this embodiment, the guide member 31 is constituted by an angled sheath having its top end connected to the bottom outlet of the second tubular portion 33B of the separator 33, and having its bottom end connected to the inlet of the cylinder 32 via a rotary connection. The bottom end of the raw coal feed pipework 6 is located above the sheath 31.

The opening of the second tubular portion 33B of the separator 33 is connected directly to the trunion 15 via an outer angled sheath 40 and a rotary connection.

An annular orifice 33C ( see FIG. 1 ) is organized above the second portion 33B, and the first portion 33A is extended by a tube coaxial with the pipework 6 and opening out into the outlet duct 36.

As a result raw coal falls into the sheath 31 and slides into the cylinder 32 to be conveyed by the internal screw of the cylinder 32 into the drum. The main air is delivered to the drum along the same path. Pulverized coal is extracted via the space 35 between the trunion 15 and the cylinder 32, along the space between the two sheaths 31 and 40, between the two tubular portions of the separator 33, and then through the zigzag path formed by the orifice 33C and the extension of the first portion 33A of the separator 33.

This embodiment has the advantage of providing complete sealing between the raw coal feed space and the space through which pulverized coal is extracted.

I claims:

1. A ball mill having a substantially horizontal axis of rotation and comprising:

a drum supported by two trunions having a same axis of rotation and disposed at respective ends of said drum;

a substantially vertical pipework operative to convey raw coal to a vicinity of a corresponding cylinder having a same axis of rotation as said drum, said cylinder being disposed within a corresponding one of said trunions so as to open out into said drum, with a space lying between said one of said trunions and said cylinder being connected to a pulverized coal outlet duct via a separator;

wherein a raw coal guide member is disposed beneath said pipework, for conveying said raw coal under gravity into an inside of said cylinder which includes a rigid Archimedes screw to convey said raw coal into said drum;

said separator, comprising:

an outer first tubular portion connected to said one of said trunions; and an inner second tubular portion coaxially disposed about a vertical axis of said outer first tubular portion, a bottom end of said pipework being disposed within said inner second tubular portion; and a main air feed provided on said pipework upstream from said separator, said air being mixed with said raw coal and channeled toward the inside of the cylinder and into said drum; and wherein said pipework has a conical member disposed at the bottom end of said pipework for preventing said channeled air from rising between said inner second tubular portion and said pipework.

2. A mill according to claim 1, wherein the separator includes an additional air feed.

3. A mill according to claim 2, wherein the additional air feed is controlled.

4. A mill according to claim 1, wherein said outlet duct includes an additional air feed.

5. A mill according to claim 1, wherein the guide member is an angled sheath connected via a bottom end to one end of the cylinder, with the bottom end of the raw coal feed pipework being disposed above said sheath.

6. A mill according to claim 5, wherein said outer first tubular portion is connected to one of said trunions via an angled sheath; and said outer first tubular portion is extended and connected to said outlet ducts, and at least one through orifice is provided in a wall of said inner second tubular portion to allow air returning from said drum to be channeled between said outer first tubular portion and said inner second tubular portion, and through said orifice to said outlet duct.

* * * * *